United States Patent [19]

Beerens

[11] Patent Number: 4,492,030

[45] Date of Patent: Jan. 8, 1985

[54] CHAIN SAW BARS

[76] Inventor: Cornelis J. M. Beerens, 40-42 Berkshire Rd., North Sunshine, Victoria, Australia

[21] Appl. No.: 409,308

[22] Filed: Aug. 18, 1982

[30] Foreign Application Priority Data

| | | | |
|---|---|---|---|
| Aug. 24, 1981 | [AU] | Australia | PF0391 |
| Aug. 29, 1981 | [AU] | Australia | PF0949 |
| Dec. 30, 1981 | [AU] | Australia | PF2105 |

[51] Int. Cl.[3] ..... B27B 17/00

[52] U.S. Cl. ..... 30/384; 83/834; 299/82; 474/156

[58] Field of Search ..... 30/383–385; 474/153, 155, 156; 299/82–84; 83/834, 833, 830

[56] References Cited

U.S. PATENT DOCUMENTS

| | | | |
|---|---|---|---|
| 893,897 | 7/1908 | Bens | 30/385 |
| 3,167,100 | 1/1965 | Consoletti | 83/834 |
| 3,283,789 | 11/1966 | Silvon | 30/384 |

FOREIGN PATENT DOCUMENTS

| | | | |
|---|---|---|---|
| 673036 | 3/1939 | Fed. Rep. of Germany | 30/384 |
| 293685 | 5/1978 | U.S.S.R. | 30/384 |

*Primary Examiner*—E. R. Kazenske
*Assistant Examiner*—Douglas D. Watts
*Attorney, Agent, or Firm*—Wigman & Cohen

[57] ABSTRACT

A chain saw having a saw chain and a chain bar, the saw chain comprising a plurality cutter links interconnected by connector links, the chain saw further having a sprocket or roller mounted for rotation in the plane of the bar adjacent the nose thereof, whereby the saw chain is guided around the nose of the chain bar, the sprocket or roller being shaped to receive driving tongues of the chain such that the cutter links of the chain are guided on a path of small radius than the path of movement of the connector links so that the depth of cut possible by the cutter links is reduced.

15 Claims, 11 Drawing Figures

CHAIN SAW BARS

This invention relates to chain saw bars and to a chain for use in combination with such a bar.

The invention is particularly directed to a chain saw bar of the type having a sprocket or a roller rotatably supported at the forward end of the bar, to guide the chain as it travels from the top to the bottom edge of the bar. Chain saw bars of these constructions are commonly referred to as "sprocket nose bars" and "roller nose bars" respectively.

Throughout this specification the reference to a "chain saw chain" means a chain comprising a plurality of alternate cutter links and connector links with drive tongue connecting each cutter link to the respective adjacent connector links. Each drive tongue is a single member located centrally of the width of the chain, and has a dependent portion to be received between successive teeth of a driving sprocket.

One of the major problems associated with the use of a chain saw is in the tendency of the saw to kick back towards the operator, when the section of the chain passing around the nose of the bar is being used to cut material. In these circumstances, the reaction force to the cutting action of the chain tends to throw the nose end of the bar upwardly and backwardly towards the operator. Hence the saw tends to pivot in this direction in the hands of the operator, and may come into contact with the body of the operator, and cause serious injury thereto.

The degree of severity of kick back is relative to the depth of cut being made by that portion of the chain travelling around the nose of the bar. In a conventional chain, the depth of cut is controlled by the depth gauge projection on the cutter link in advance of the cutting edge. If the depth gauge projection was set so that a relatively small cut is made by each cutter link, the severity of kick back would be reduced. However, this would also result in a reduction of the cutting rate of the chain when being used on the straight portion of the cutter bar and is therefore undesirable.

In addition, the depth gauge projection on a conventional chain, can induce a degree of kick back, for as the chain passes around the curved nose portion of the bar, the depth gauge projection rises to the surface of the cut, which will allow the depth gauge projection to dig into the material in a manner similar to the cutting edge. This digging in of the depth gauge projection produces the same type of reaction as the cutting edge of the cutter link, and so also contributes to the risk of kick back. Further as the cutter link undergoes changes in angular attitude to the cut surface of the material, as it passes around the nose portion of the bar, the cutting edge of the cutter link may take a deeper cut than is possible when the chain is moving along the straight portion of the bar.

Thus, at present, it is necessary to make a compromise between the acceptable rate of cutting when operating on the straight portion of the bar, and the degree of safety required when cutting with the nose portion of the bar.

Skilled operators of chain saws are aware of the tendency for the saw to kick back, and accordingly take precautions to guard against possible injury, when using the nose portion of the bar for cutting. However, there are other occasions when the nose portion of the chain may accidentally come in contact with an object that offers resistance to the cutting action of the cutter link and therefore kick back may occur when the operator is not prepared. Also it will be appreciated that risk of kick back and resultant serious injury are always present when a chain saw is being used by an unskilled operator.

It is the object of the present invention to provide a chain saw bar, and a chain saw bar and chain combination which will eliminate or at least reduce the risk of kick back when cutting with the nose portion of the bar, without sacrificing the cutting efficiency when cutting with the chain on the straight portion of the bar.

With this object in view there is provided a chain saw bar of the type having a nose end of curved shape to support the chain as it passes around the nose end, wherein the nose end is adapted to reduce the effective cutting depth of the cutter links of the chain whilst passing around the nose end of the bar.

Conveniently the nose portion of the bar is provided with a member forming part of or rotatable co-axially with the roller or sprocket fitted to the nose of the bar, and having a peripheral surface of a radius greater than that travelled by the depth gauge projections of the cutter links as they pass around the nose of the bar. The member may be arranged on one or one member on each side of the chain, and so that the radius of the peripheral surface is at least greater than that of the path of the depth gauge projection on the cutter links. Preferably the radius of the peripheral surface is at least not less than that of the cutting edge of the cutter links of the chain.

When the member or members are located to the side of the chain, spaced notches are provided in the peripheral surface of each member to receive the cutting portion of the cutter links of the chain. If a member is provided only on one side of the chain then a notch is required for only each second cutter link. If a member is provided on each side, alternate teeth will be received in notches in opposite members.

When the roller or sprocket is provided at the nose portion of the bar, to support the chain and in such a bar the roller or sprocket is adapted so the cutter links of the chain travel on an arcuate path of lesser diameter than that travelled by the connector links of the chain, as the chain passes around the nose.

In a construction wherein a sprocket is used, teeth may be provided on the sprocket to engage each connector link of the chain, and no teeth or teeth of lesser height, are provided to engage with the cutter links. Preferably the peripheral space, between the teeth that engage the connector links, is shaped so the cutter link and the drive tongues connected to each end thereof, are in a substantially straight line relationship as they travel around the nose portion of the bar. This shape and arrangement of the nose sprocket reduces the radius of the path travelled by the cutting edge of the cutter links, relative to the radius of the path travelled by the connector links, and so reduces the depth of cut that the cutter link may make.

Similarly, if the nose portion of the bar is provided with a roller to support the chain, the cutter links are received in notches in the peripheral surface of the roller, between the portions of the peripheral surface that support the connector links.

Where the bar is of the roller nose type, with the roller having two axially spaced peripheral edge surfaces defining therebetween a groove to receive the drive tongues of the chain, each said edge surface may be provided with a plurality of circumferentially spaced connector links support surfaces, with a cutter link receiving recess between each support surface. The alternating support surfaces and recesses in the respective edge surfaces being aligned in the axial direction of the roller, and the recesses being spaced in the circumferential direction so that, in use, as the chain passes around the nose of the bar, each connector link rests on a support surface, and each cutter link is located in a recess.

The provision of the recesses in the peripheral surface of the roller to receive the cutting links, has the effect of allowing the connector links of the chain to travel along a first arcuate path, and the cutter links to travel on a second arcuate path of lesser radius than that of the connector links. Accordingly the effective cutting height of the cutting edge of the cutting link is reduced, as the cutting link passes around the nose portion of the bar, and thus the risk and severity of kick back is correspondingly reduced.

Preferably the depth of the recesses is such that the cutter link, and the drive tongues connected to each end thereof, are in a substantially straight line relationship as they travel around the nose roller.

This general construction may also be incorporated in only one peripheral edge of the roller, the other peripheral edge being conventional with a continuous smooth surface. Alternatively the roller may have only one peripheral surface to support the chain, the other side of the groove to guide the chain being formed by an extension of the bar.

With any of these constructions of the nose roller, it will be appreciated that the beneficial results are only achieved if the connector links are supported on the higher or raised portion of the peripheral surface of the roller, and the cutting links are located in the intervening recesses. Accordingly it is important to ensure that the chain is initially correctly assembled to the roller, and maintains this correct assembly during use.

With this end in view, it is proposed that the support surface portions of the roller be provided with a radially extending projection or identation with a complementary formation on the mating face of the connector link of the chain. No such complementary formation is provided on the cutter links of the chain. Accordingly the chain can only be assembled to the roller with the connector links on the raised portions of the roller periphery. Preferably the support portions of the roller are provided with radial projections, and complementary recesses are provided in the mating face of the connector links. If the opposite arrangement were used there would still be the possibility that the chain could be assembled with the cutter links on the higher support surface portions of the roller, as the cutter links could span the indentations or recesses therein.

It will be appreciated that although each connector link of a chain normally comprises two transversely spaced elements, it is strictly only necessary to provide the complementary formation of a projection or identation on one of those elements of each connector link. However from the point of view of mass production, it is more convenient to provide the indentation or projection in both of the elements of each connector link.

It will also be appreciated that each cutter link normally comprises two transversely spaced elements, one carrying the actual cutting edge and depth gauge projection, and the other being a conventional link. Again it is preferable that the edge of each of the elements of the cutter link that engage the nose roller, do not have recesses or projections complementary to those provided on the connector links, otherwise there would still be the possibility of the chain being incorrectly mounted on the roller.

Thus there is also provided according to the present invention a chain for a chain saw wherein the connector link comprises two transversely spaced elements, at least one of which is provided with a notch, in the edge thereof that contacts the edge of the chain saw bar, so that the notch may co-operate with a complementary formation on the roller of a roller nose bar, the cutter links of the chain being not provided with notches in the edges thereof which engages the cutter bar. Conveniently such a notch is provided in each of the elements of the connector link.

The invention will be more readily understood from the following description of various practical arrangements of the present invention as illustrated in the accompanying drawings.

Figure 1:
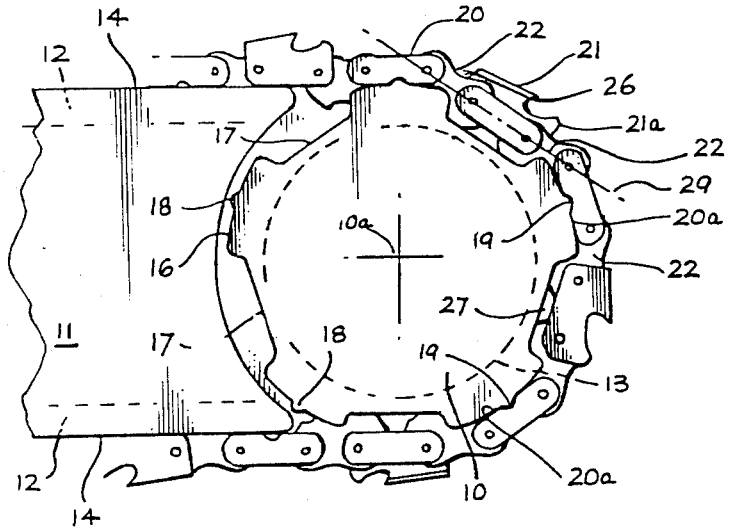
FIG. 1 is a side view of the nose portion of a chain saw bar having a roller nose.
Figure 2:
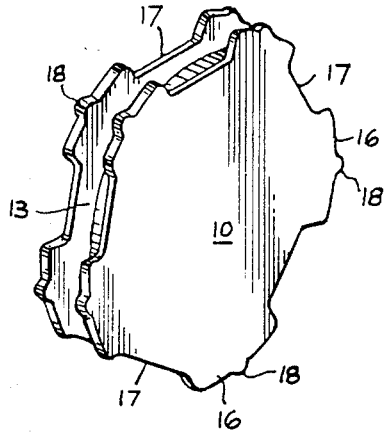
FIG. 2 is a perspective view of the roller as used in the bar shown in FIG. 1.

Referring now to FIGS. 1 and 2 there is depicted a portion of the roller nose of a chain bar incorporating the features of the present invention, that part of the bar not shown is of conventional construction. The roller 10 is mounted on the forward portion of the bar 11, for rotation about an axis 10*a* transverse to the plane of the bar. The roller 10 is preferably mounted on an antifriction bearing in the customary manner. Bearing constructions for the support of the roller of a cutter bar are well-known and any of these constructions could be incorporated in the current roller. The upper and lower edges of the bar 11 are provided with central grooves 12, of conventional form, to receive the drive tongue of the chain, and to permit the respective elements of the cutter link to be slidably supported on the edge faces 14 on either side of the groove 12.

The roller has a peripheral groove 13, which is in the same plane as the groove 12 in the bar 11, and is for the purpose of receiving the drive tongues 22 of the chain as it passes around the nose roller. In a conventional roller, the peripheral surface of the roller on either side of the groove 13 would be continuous and of uniform diameter, however, in accordance with the present invention these edge surfaces are modified. The modification comprises providing around the circumference of each peripheral edge a plurality of equally spaced recesses 17 with the recesses in the respective edge surface aligned in the axial direction of the roller. On each of the remaining portions 16 of the edge surface of the rollers, between adjacent recesses, there is provided a central projection 18. Complementary notches 19 are provided in the lower edge 20*a* of the connector links 20 to receive the projections 18. As no notches are provided in the cutter links 21 they will not seat on the projection 18 and so there is a safeguard against incorrect assembly of the chain on the roller, or slipping of the chain after assembly to the roller. It should, however, be realised that in some forms of the invention the projections 18 are only required to be provided on the peripheral edge surface of the roller on one side of the groove 13.

The circumferential length of each of the recesses 17 is such that, in use, only the connector links 20 of the chain are supported on the portions 16 of the roller edge surface between the recesses 17. The cutter links 21 of the chain are located wholly in the recesses 17, so as to not be in contact with the outer edge surface of the roller, and preferably not to be in contact with the base of the recess.

As can be seen in the drawings, the provision of the recess 17 to receive the cutter link, enables each cutter link 21, and the drive tongues 22 at each end thereof, to take up a straight line relationship, as indicated by the line 29 whilst passing around the nose roller. By this provision, the effective radius of the cutting edge 26 of the cutting link is reduced, relative to the radius that it would follow on a conventional roller. Accordingly the effective depth of cut that can be made by the cutting edge while travelling around the nose roller is also reduced. As a result, the extent of kick back that may occur is also reduced, as kick back is proportional to the depth of cut.

Further by providing a clearance 27 between the base of the recess 17 and the underface of the cutter link 21, as the cutter link travels around the nose roller, pressure applied to the cutting edge to induce a cutting action, can result in a deflection of the cutter link further inwardly towards the axis of the roller. This further reduces the effective cutting height of the cutting edge, and hence a further reduction in the risk of kick back, and the potential extent of kick back if it does occur, is obtained.

Figure 3:
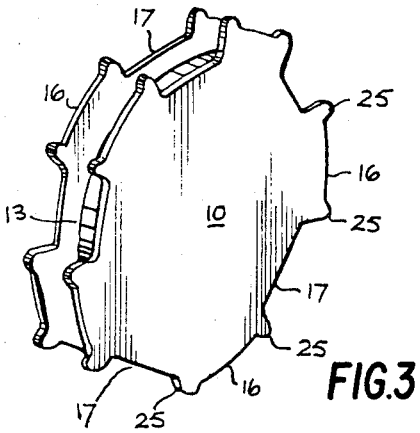
FIGS. 3 and 4 show modifications to the construction of the roller as shown in FIG. 1, and FIG. 4 includes a modification to the chain.

An alternative configuration of the roller is shown in FIG. 3 wherein the necessity of notches 19 in the lower edge 20*a* of the connector links 20 is avoided and so a conventional chain may be used.

In this alternative the portions 16 of the roller edge have a radial extension 25 at each end, so that the connector links 20 will nest therebetween, and thus prevent slippage of the chain on the roller.

Figure 4:
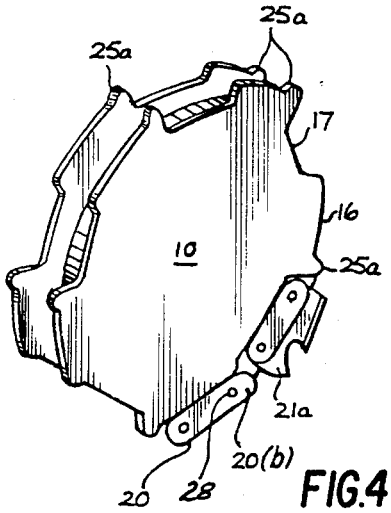

In a still further alternative only one projection 25*a* may be provided at the leading edge of the higher peripheral portion 16 of the roller as shown in FIG. 4.

It is also possible to provide a roller with recesses 17 as previously described, and in addition provide sprocket like teeth in the groove 13 of the roller to cooperate with the connector links 20. When such teeth are provided it is only necessary to provide a single sided roller.

It should also be understood that as the chain passes around a conventional nose portion of a bar, the depth gauge projection 21*a* on the cutter link may also dig into the material being cut, and produce a reaction that promotes kick back of the saw. Because of the curved path being travelled by the chain, the connecting link 20 in advance of the cutter link may be in contact with the base of the groove being formed by the cutting action of the chain, and thus this portion of the connector link acts as the depth control rather than the depth gauge projection 21*a* on the cutter link. However, even in the these circumstances the modifying of the roller as previously discussed, also contributes to the reduction in any kick back effect that may arise as a result of the depth gauge projection becoming embedded in the material being cut.

In order to further reduce kick back, as a result of the depth gauge projection 21*a* on the cutter link digging into the material being cut, it is proposed that the end 20*b* of the connector link 20, immediately forward of the depth gauge projection end of the cutter link, extend a greater distance than normal beyond the axis of the rivet 28 pivotally connecting the connector link, towards the forward end of the trailing cutter link. By this construction, as shown in FIG. 4, as the chain passes around a nose roller, the trailing end of the extended end portion 20*b* of the connector link 20 will rise to a greater extent than a conventional connector link. This results in a further reduction in the effective height of the depth gauge projection 21*a* and thus reduces the extent that the depth gauge projection may dig into the material being cut whilst passing around the nose portion of the bar.

As discussed above one of the problems associated with the construction disclosed in FIGS. 1 and 2 is to ensure that, in use, the cutter links 21 remain in the correct relationship with the recesses 17 in the nose roller 10. If the cutter links were to take up a position on the greater radius portion 16 of the roller, with the connector links 20 in the intervening recesses 17, the potential kick back problem would be increased rather than decreased. Hereinbefore there are disclosed various constructions of the surfaces of the roller, and the shape of the co-operating portions of the chain, that reduce the risk of the chain being initially positioned on the roller 10 in the incorrect position, and that reduce the risk of the chain taking up such an incorrect position during use of the saw.

This effect may be achieved by the use of a chain with a roller nose bar as previously disclosed, wherein the connector links of the chain are shaped to complement the shape of the peripheral surface of the roller between the recesses in that peripheral surface.

Figure 5:
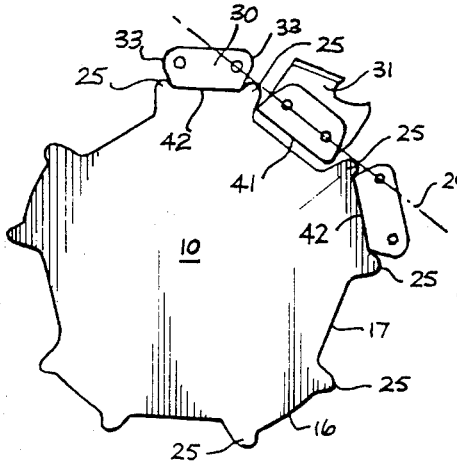
FIG. 5 shows a further modification to the chain that is suitable for use with the roller shown in FIG. 3.

Conveniently, as shown in FIG. 5 the radially inner face 41 of the cutter links 31 is longer than the radially inner face 42 of the connector links 30, and longer than the distance between radial projections 25 at the respective ends of the peripheral surface 16 of the roller between the recesses 17, so the cutter links are not receivable between the radial projections.

Alternatively the cutter links may be of an overall length greater than the connector links 30 so that the cutter links will not fit between the projections 25 on the periphery of the roller.

Also, if a roller constructed as shown in FIG. 3, is used with a chain having connector links 30 with both end faces 33 inclined outwardly so the long longitudinal side is outermost as illustrated in FIG. 5, then the same link may be reversed with the short longitudinal side radially outermost, and used as the plane plate of the cutter links 31. With such a construction, if the chain is incorrectly assembled to a roller of the construction shown in said FIG. 5, the radially inner long side 41 of the plate of the cutter link will not be receivable between the radial extensions 25 on the periphery of roller.

As is known, in a conventional chain of a chain saw, the cutting edge of the cutting links project laterally beyond each of the opposite sides of the chain so that the cutting edge is the widest part of the chain. This ensures that the chain will have side clearance in the groove formed by the cutting action of the cutting edges and thus reduce frictional drag on the chain. This lateral projecting characteristic of the cutting edge on the cutter links of the chain provides a facility whereby a guide may be fitted to ensure that the chain is initially assembled to the roller of the bar with the cutter links located in the recesses provided in the roller.

With this aspect in mind there is provided a chain mounting guide to be fitted to a roller nose bar wherein the roller has a plurality of peripheral recesses spaced to receive the cutter links of a saw chain assembled to the guide bar, said mounting guide comprising a member adapted to be attached to the roller in a side by side relation and at a predetermined angular relationship to the axis of the roller, at least one recess in the periphery of said member shaped and located to receive the cutting edge portion of a cutter link of a chain mounted on the bar, when that cutter link is located in one of said peripheral recesses of the roller and the member is attached to the roller as above specified.

By using a chain mounting guide of the above design, in conjunction with a roller nose chain as previously described, the chain may only be fitted to the roller in the correct location with the cutter link located in the recess of the roller. If it is attempted to fit the chain to the roller in any other location, the mounting guide will prevent the chain seating on the roller as the lateral projecting portion of the cutter link will foul the mounting guide. In other words, when the mounting member is attached to the roller, the recess in the mounting member will be in register with one of the recesses in the roller, so that, when the cutter link is positioned in that recess in the roller, the laterally projecting portion of the cutter link will be received in the recess in the mounting member, thus permitting assembly of the cutter chain to the bar. However, if it is endeavoured to assemble the chain to the roller in any position other than the correct position, the laterally projecting portion of the cutter link will foul the mounting guide and thus prohibit assembly of the chain to the bar.

Conveniently the mounting member is arranged so that it can be attached to the roller by a bolt or other suitable fastening co-operating in a co-axial manner with the roller. The mounting member and roller have co-operating components offset from the axis of the roller so that the mounting member may only be fitted to the roller in the one predetermined angular relationship determined by when these components co-operate correctly.

Figure 6:
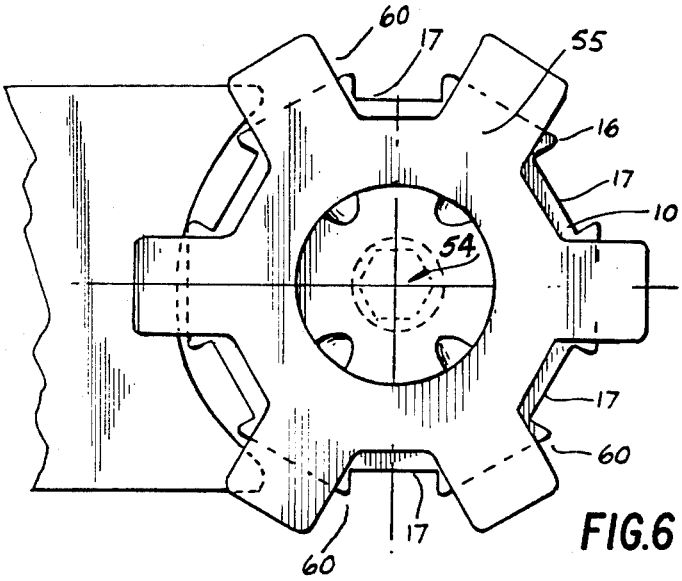
FIG. 6 is a view similar to FIG. 1 with the chain removed and a chain mounting guide fitted to the roller.
Figure 7:
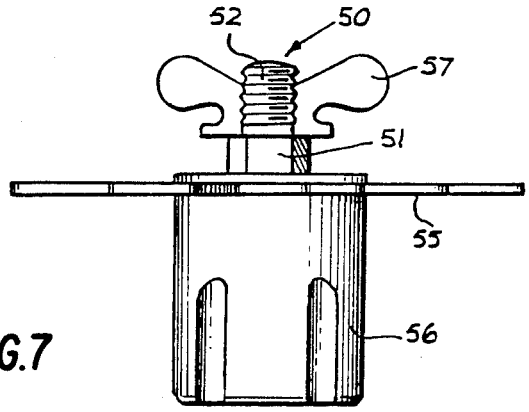
FIG. 7 is a plane view of the chain mounting guide as shown in FIG. 6 removed from the roller.

One embodiment of the mounting guide is illustrated in FIGS. 6 and 7 of the drawings for fitment to a roller having a co-axial aperture therethrough. The shaft 50 has a portion 51 of hexagonal cross section and a threaded portion 52. The roller 10 has the co-axial aperture 54 of hexagonal shape to non-rotatably receive the shaft portion 51, and are held in assembly by the wing nut 57.

The plate 55 is secured to the shaft 50 and the handle 56, that may be gripped by the operator and manipulated in a manner to turn the roller, and hence progress the chain along the guide bar manually. The provision of this handle or grip is not directly related to the operation of the guide member in locating the chain, however, it does provide a convenient means of advancing the chain, such as to ensure that it is freely running on the guide bar, and it is also convenient for advancing the chain during sharpening operations.

The plate 55 is of a discal shape with six recesses 60 in the periphery, equal to the number of peripheral recesses 17 in the roller 10. The recesses 60 are spaced so as to register with the respective recesses 17 in the roller. The arms formed between the recesses 60 extend beyond the periphery of the roller.

In the construction of the roller described earlier in this specification, having recesses to receive the cutter links of the chain, there is a tendency for the links to remain in engagement in the recesses and to continue to follow the circular path rather than to move away from the circular path onto the lower edge of the guide bar. This tendency leads to additional wear on the faces of the guide bar at the point where the links of the chain transfer from the roller to the guide bar.

In a conventional roller there is provided a groove in the central plane thereof in which the driving tongues of the chain are received. In some constructions the groove is formed by an extension of the guide bar which is of a thinner section than the main body of the guide bar, and the roller is formed by independent discs on either side of this extension and supported in a bearing carried by the extension.

It is, therefore, a further proposal to shape the extension of the guide bar so that as the chain travels around the roller towards the lower edge of the guide bar, the driving tongues co-operate with an inclined face which forms a smooth transition between the base of the roller and the edge of the bar.

Figure 8:
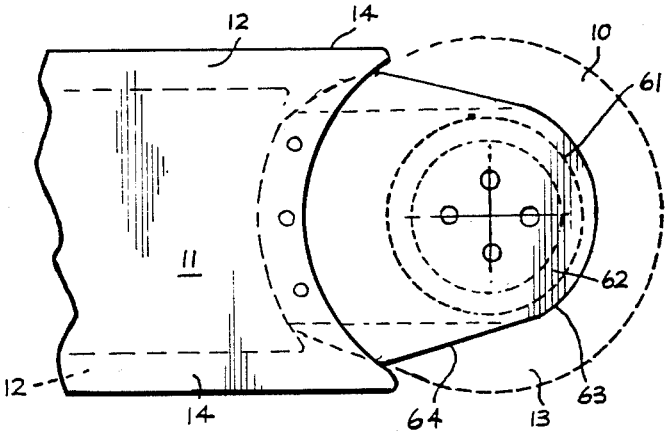
FIG. 8 is a side view of the nose portion of the bar with the roller removed to show a specific contour of the extension of the bar that supports the roller.

Referring now to FIG. 8 of the drawings the forward portion of the guide bar 11 is provided with a longitudinal extension thereof 61 which carries a bearing assembly 62 to support the roller 10. The extension 61 has a contour which is arcuate over approximately 90°–100° on the forward end 63, and then has a surface 64 tangential to the arc, which extends out to a point generally in line with the base of the groove 12 in the guide bar. It will be observed that the depth of the groove 13 between the discs forming the roller, progressively decreases along this tangential surface, and accordingly the chain will be gradually lifted out of engagement with the periphery of the roller as it transfers from the roller onto the straight edge of the bar. Preferably the depth of the groove in the area where the chain passes back onto the bar is such that the links of the chain are not in contact with the roller or the bar, but are supported by the drive tongues sliding along the tangential face 64.

Figure 9:
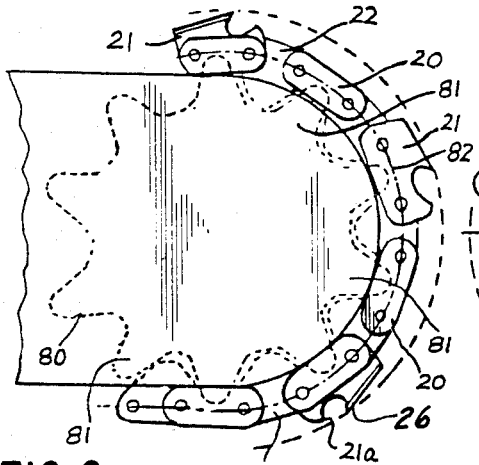
FIG. 9 is a side view of the nose portion of a chain saw bar with a conventional sprocket nose.

FIG. 9 of the drawings illustrates a conventional sprocket nose bar, wherein a sprocket 80 is located between the two opposite side sections of the bar, with the teeth of the sprocket engaging with both the cutter links 21 and the connector links 20, and the drive tongues 22 extending into the space between the respective teeth 81 of the sprocket. In this construction all of the rivets of the chain travel on a common arcuate path 82 as the chain moves around the nose portion of the bar, and accordingly the depth gauge projections 21*a* and the cutting edges of the cutter links will operate in the conventional manner with the usual risk of kick back.

Figure 10:
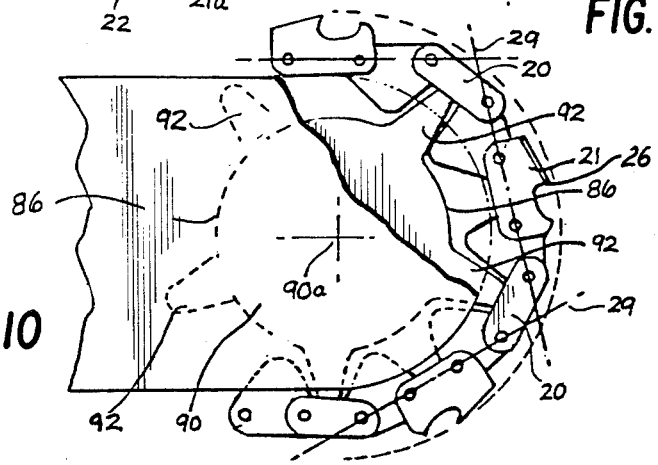
FIG. 10 is a view similar to FIG. 9 partly in section with the sprocket modified in accordance with this invention.

When one form of the present invention is applied to a sprocket nose bar, each alternate tooth on the sprocket is omitted as shown in FIG. 10 so that only the connector links 20 engage with the teeth on the sprocket 90, and the cutter links 21 are substantially clear of the sprockets as seen in FIG. 10.

In this way there is no support provided for the cutter link 21, and so the cutter links and drive tongues will take up a straight line relationship between the two connector links that are supported on the sprocket teeth. This is diagramatically illustrated by the line 29 in FIG. 11 from which it will be seen that the radial distance from the centre of the sprocket 90*a* to the tip of the cutting edge 26 of the cutter links is reduced, compared with that which it would occupy on the conventional sprocket. Accordingly the effective depth of cut would be correspondingly reduced with a resultant reduction in kick back force.

Preferably the portion 86 of the sprocket 90 between the widely adjacent teeth 92 is undercut to a sufficient degree that the center link may in fact be displaced inwardly from the straight line 29 adjoining the two adjacent connector links. This has the effect that, if a load is applied to the cutter link, as a result of it engaging with a cuttable material, the cutter link will be deflected inwardly from the straight line position to further reduce the depth of cut.

Figure 11:
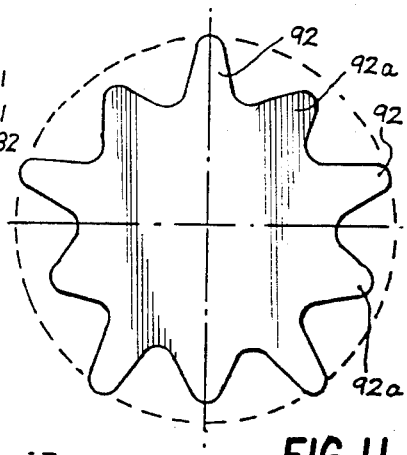
FIG. 11 is a view of an alternative sprocket that may be substituted for that shown in FIG. 10.

In a further variation as shown in FIG. 11 teeth 92*a* are provided to co-operate with the cutter links, but the height of these teeth is less than the height of the teeth 92 which engage the connector links. Accordingly the radial distance from the sprocket centre to the tip of the cutting edge 25 of the cutter links is correspondingly reduced to achieve a similar effect to the omission of the teeth as previously discussed with reference to FIG. 10.

I claim:

1. In a chain saw comprising a chain saw bar having opposite longitudinal edges each comprising a central longitudinal guide groove and a longitudinal support surface on each side of the guide groove, and a chain adapted to travel about the periphery of the bar, said chain having a plurality of alternate equi-spaced cutter and connector links and a drive link pivotally connecting each cutter link to the adjacent connector links, said cutter and connector links each having inner edge faces that slidably engage the support surfaces of the bar and each drive link having an inwardly extending tongue that is received in the guide groove, the improvement comprising:

a support member mounted on one end of the bar for rotation in the plane of the bar, a peripheral edge on said support member to support the chain as it passes from one edge of the bar to the opposite edge, said peripheral edge of the support member being adapted to guide the cutter links and the connector links on respective paths as the chain passes round the support member, the path of the inner edge surface of cutter links being located radially inwardly of the path of the inner edge surface of the connector links, the peripheral surface of the support member having a plurality of equi-spaced recesses along the length thereof arranged so that the cutter links of the chain are received in respective recesses and the connector links of the chain are supported on the portions of the peripheral surface between the recesses.

2. In a chain saw the combination as claimed in claim 1 wherein the recesses are shaped so that each cutter link and the drive links connected to each end thereof occupy a straight line relationship when the cutter link is located in the recess and the adjacent connector links are supported on said portions of the peripheral surface.

3. In a chain saw the combination as claimed in claim 1 wherein the connector links and the portions of the peripheral surface between the recesses have respective elements that interfit as the chain passes around the nose of the bar.

4. In a chain saw the combination as claimed in claim 1 wherein the portions of the peripheral surface between the recesses have a pair of outwardly projecting ends, said ends being spaced apart such that a connector link may be received therebetween.

5. In a chain saw the combination as claimed in claim 1 wherein the portions of the peripheral surface between the recesses each have an outwardly projecting end at the forward edge of each of said portions to abut the forward end of the connector link when supported on said portion of the peripheral surface.

6. In a chain saw the combination as claimed in claim 1 wherein the support member is a sprocket with the teeth of the sprocket arranged so that only the connector links are supported by sprocket teeth as they pass around the nose of the bar and the cutter links are located in the spaces between the teeth.

7. In a chain saw the combination as claimed in claim 6 wherein the teeth of the sprocket and the spaces therebetween are arranged so each cutter link and the drive links connected to each end thereof occupy a straight line relationship when the adjacent connector links are supported on the teeth.

8. In a chain saw the combination as claimed in claim 1 wherein the support member is a sprocket having a first series of teeth to support the connector links and a second series of teeth to support the cutter links, the second series of teeth being of less radial length than the first series such that the cutter lengths travel a path of smaller radius than the connector links supported on the teeth of the first series.

9. In a chain saw the combination as claimed in claim 4 wherein the inner edge surface of the cutter links is of a length greater than the distance between the projections at the ends of the portions of the peripheral surface of the support member so the cutter links cannot be received between said projections.

10. In a chain saw the combination as claimed in claim 1 wherein each connector link has a notch in the inner edge surface thereof, and each said portion of the peripheral surface of the support member has an outward projection to respectively interfit with said notch as the chain passes around the support member, and each cutter link has no notch to receive said projections.

11. A chain mounting guide for use in conjunction with the combination claimed in claim 1 comprising a member adapted to be attached to the support member in a side-by-side relation and at a predetermined angular relation to the axis of the support member, at least one recess in the periphery of the guide member shaped and located to register with a recess in the periphery of the support member when the guide member is so attached to the support member and the guide member will extend radially outward of the portions of the peripheral surface of the support member on either side of said recess in the support member.

12. In a chain saw bar having opposite longitudinal edges each comprising a central longitudinal guide groove and a longitudinal support surface on each side of the guide groove adapted to support a chain as the chain travels about the periphery of the bar, said chain having a plurality of alternate equi-spaced cutter and connector links and a drive link pivotally connecting each cutter link to the adjacent connector links, said cutter and connector links each having inner edge faces that slidably engage the support surfaces of the bar and each drive link having an inwardly extending tongue that is received in the guide groove, the improvement comprising an extension at the forward end of the bar, a discal member located on each side of said extension and rotatably supported thereby for rotation about an axis transverse to the bar, said extension and discal members defining a groove along which the tongues of the drive links travel as the chain passes around the forward end of the bar, said extension forming the base of said groove and being contoured so that the tongues of the drive links are in contact with the said base of the groove as the chain passes from the discal members to the bar, and so that the links of the chain onto the bar are raised clear of the bar as the chain passes from the discal members to the bar.

13. A chain saw bar as claimed in claim 12, wherein the extension is contoured so as to also raise the links of the chain clear of the bar during passage from the bar to the discal members.

14. In a chain saw comprising a chain saw bar having opposite longitudinal edges each comprising a central longitudinal guide groove and a longitudinal support surface on each side of the guide groove, and a chain adapted to travel about the periphery of the bar, said chain having a plurality of alternate equi-spaced cutter and connector links and a drive link pivotally connecting each cutter link to the adjacent connector links, said cutter and connector links each having inner edge faces that slidably engage the support surfaces of the bar and each drive link having an inwardly extending tongue that is received in the guide groove, the improvement comprising:

a support member mounted on one end of the bar for rotation in the plane of the bar, a peripheral edge on said support member for supporting the chain as it passes from one edge of the bar to the opposite edge, the peripheral edge of said support member having means defining two circumferential paths of travel around said support member for supporting said connector and cutting links, the path of travel followed by said cutter links having a smaller radius than the path of travel followed by said connector links, wherein the pivot points of each cutter link connecting the cutter link to the drive links adjacent thereto and traveling on the circumferential path having the smaller radius and the pivot points connecting said adjacent drive links to a respective connector link and traveling on the other circumferential path are arranged in a substantially straight line when disposed about the support member.

15. In a chain saw comprising a chain saw bar having opposite longitudinal edges each comprising a central longitudinal guide groove and a longitudinal support surface on each side of the guide groove, and a chain adapted to travel about the periphery of the bar, said chain having a plurality of alternate equi-spaced cutter links having a cutting edge, connector links, and a drive link pivotally connecting each cutter link to the adjacent connector links, said cutter and connector links each having inner edge faces that slidably engage the support surfaces of the bar and each drive link having an inwardly extending tongue that is received in the guide groove, the improvement comprising:

a support member mounted on one end of the bar for rotation in the plane of the bar, a peripheral edge on said support member to support the chain as it passes from one edge of the bar to the opposite edge, said peripheral edge of the support member being constructed to guide the pivot points of the cutting links on a circumferential path of a first smaller radius and the pivot points of the connecting links on a circumferential path of a second radius, said first radius being smaller than the second radius whereby kickback of the chain saw is minimized.

* * * * *